US009224402B2

(12) United States Patent
Shechtman

(10) Patent No.: US 9,224,402 B2
(45) Date of Patent: Dec. 29, 2015

(54) WIDEBAND SPEECH PARAMETERIZATION FOR HIGH QUALITY SYNTHESIS, TRANSFORMATION AND QUANTIZATION

(71) Applicant: International Business Machines Corporation, Armonk, NY (US)

(72) Inventor: Slava Shechtman, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 173 days.

(21) Appl. No.: 14/040,765

(22) Filed: Sep. 30, 2013

(65) Prior Publication Data

US 2015/0095035 A1 Apr. 2, 2015

(51) Int. Cl.

| | |
|---|---|
| ***G10L 13/06*** | (2013.01) |
| ***G10L 19/00*** | (2013.01) |
| ***G10L 13/08*** | (2013.01) |
| ***G10L 19/06*** | (2013.01) |
| ***G10L 19/038*** | (2013.01) |
| ***G10L 19/02*** | (2013.01) |

(52) U.S. Cl.

CPC ..... *G10L 19/038* (2013.01); *G10L 19/02* (2013.01)

(58) Field of Classification Search

USPC ..... 704/266, 209, 233, 270, 205, 220, 264, 704/500

See application file for complete search history.

(56) References Cited

U.S. PATENT DOCUMENTS

| | | | | |
|---|---|---|---|---|
| 5,504,833 | A | 4/1996 | George et al. | |
| 6,269,332 | B1 * | 7/2001 | Choo et al. | 704/233 |
| 6,434,519 | B1 * | 8/2002 | Manjunath et al. | 704/205 |
| 6,496,797 | B1 * | 12/2002 | Redkov et al. | 704/220 |
| 7,191,128 | B2 * | 3/2007 | Sall et al. | 704/233 |
| 7,222,075 | B2 * | 5/2007 | Petrushin | 704/270 |
| 7,454,330 | B1 | 11/2008 | Nishiguchi et al. | |
| 7,567,900 | B2 * | 7/2009 | Suzuki et al. | 704/233 |
| 7,627,475 | B2 * | 12/2009 | Petrushin | 704/270 |

(Continued)

FOREIGN PATENT DOCUMENTS

| | | |
|---|---|---|
| EP | 0780831 | 4/2002 |

OTHER PUBLICATIONS

Song et al., "Harmonic enhancement in low bit-rate audio coding using an efficient long-term predictor", EURASIP Journal on Advances in Signal Processing archive, vol. 2010, Article No. 66 , Feb. 2010.

(Continued)

*Primary Examiner* — Satwant Singh

(57) ABSTRACT

A method for speech parameterization and coding of a continuous speech signal. The method comprises dividing said speech signal into a plurality of speech frames, and for each one of the plurality of speech frames, modeling said speech frame by a first harmonic modeling to produce a plurality of harmonic model parameters, reconstructing an estimated frame signal from the plurality of harmonic model parameters, subtracting the estimated frame signal from the speech frame to produce a harmonic model residual, performing at least one second harmonic modeling analysis on the first harmonic model residual to determine at least one set of second harmonic model components, removing the at least one set of second harmonic model components from the first harmonic model residual to produce a harmonically-filtered residual signal, and processing the harmonically-filtered residual signal with analysis by synthesis techniques to produce vectors of codebook indices and corresponding gains.

20 Claims, 4 Drawing Sheets

(56) References Cited

U.S. PATENT DOCUMENTS

| | | | | |
|---|---|---|---|---|
| 8,200,497 | B2 * | 6/2012 | Hardwick | 704/500 |
| 8,332,228 | B2 | 12/2012 | Vos et al. | |
| 8,392,179 | B2 | 3/2013 | Yu et al. | |
| 2003/0135374 | A1 * | 7/2003 | Hardwick | 704/264 |
| 2009/0254341 | A1 * | 10/2009 | Yamamoto et al. | 704/233 |
| 2012/0029923 | A1 | 2/2012 | Rajendran et al. | |
| 2013/0080157 | A1 | 3/2013 | Kim et al. | |
| 2014/0309992 | A1 * | 10/2014 | Carney | 704/209 |

OTHER PUBLICATIONS

Julien Epps, "Wideband extension of narrowband speech for enhancement and coding.", A thesis submitted to fulfill the requirements of the degree of Doctor of Philosophy at The University of New South Wales, Sep. 2000.

Althoff et al., "Extracting sinusoids from harmonic signals", Proceedings of the 2nd COST G-6 Workshop on Digital Audio Effects (DAFx99), NTNU, Trondheim, Dec. 9-11, 1999.

Atal et al., "Advances in Speech Coding", 1990.

Mcaulay et al., "Speech analysis synthesis based on a sinusoidal representation", IEEE Transactions on Acoustics, Speech and Signal Processing, vol. 24, Issue 4, 1986.

George et al., "Speech analysis/synthesis and modification using and analysis-by synthesis/overlap-add sinusoidal model", IEEE Transactions on Speech and Audio Processing, vol. 5, No. 5, Sep. 1997.

Shechtman et al., "Sinusoidal model parameterization for HMM-based TTS system", In Proceeding of INTERSPEECH 2010, 11th Annual Conference of the International Speech Communication Association, 2010.

Sorin et al., "Uniform Speech Parameterization for Multi-Form Segment Synthesis", In Proceeding of INTERSPEECH 2011, 12th Annual Conference of the International Speech Communication Association, 2011.

* cited by examiner

WIDEBAND SPEECH PARAMETERIZATION FOR HIGH QUALITY SYNTHESIS, TRANSFORMATION AND QUANTIZATION

FIELD AND BACKGROUND OF THE INVENTION

The present invention, in some embodiments thereof, relates to speech parameterization and coding and, more particularly, but not exclusively, to techniques for speech compression, high quality reconstruction and transformation in the parametric domain.

Various speech parameterization and coding techniques have been developed over the last decades, as described in the *Springer handbook of speech processing*, edited by Jacob Benesty, M. Mohan Sondhi, and Yiteng Huang (London UK, Springer, 2008), which is incorporated herein by reference. The sinusoidal model (SM) of speech is described by R. McAulay and T. Quatieri in "Speech analysis synthesis based on a sinusoidal representation," (IEEE Trans. Acous. Speech, and Sig. Proc., vol. 34, no. 4, pp. 744-754, August 1986), which is incorporated herein by reference, is very popular for speech transformations in the parametric domain, which may include such changes as prosody modification, spectral warping, gender change and alike. The code-excited linear prediction (CELP) coding is very common for speech compression and high quality reconstruction, described by B. Atal, V. Cuperman, and A. Gersho, in Advances in Speech Coding (Kluwer, Norwell, Mass., 1990), which is incorporated herein by reference.

These two methods, SM and CELP, applied together, such as described by G. Jeong in "Embedded bandwidth scalable wideband codec using hybrid matching pursuit harmonic/CELP scheme", published in J. Intell. Manuf. (2012) 23:1315-1325, or as the known in the art Harmonic Vector Excitation Coding method, described in ISO/IEC standard number 14496, which are incorporated herein by reference, compromise quality of signal reconstruction for lower bandwidth needs during data transmission, as described by L. Leutelt and U. Heute in "Voice Conversion: Adaptation of Relative Local Speech Rate by MPEG-4 HVXC" presented at the EUSIPCO conference of 2002, vol. 3, pp. 113-116, which is incorporated herein by reference.

SUMMARY OF THE INVENTION

According to some embodiments of the present invention there is provided a method for speech parameterization and coding of a continuous speech signal. The method comprises dividing the continuous speech signal into a plurality of speech frames, and for each one of the plurality of speech frames, modeling said speech frame by a first harmonic modeling to produce a plurality of harmonic model parameters, reconstructing an estimated frame signal from the plurality of harmonic model parameters, subtracting the estimated frame signal from the speech frame to produce a harmonic model residual signal, performing at least one second harmonic modeling analysis on the first harmonic model residual to determine at least one set of second harmonic model components, removing the at least one set of second harmonic model components from the first harmonic model residual signal to produce a harmonically-filtered residual signal, and processing the harmonically-filtered residual signal with analysis by synthesis techniques to produce vectors of codebook indices and corresponding gains.

Optionally, the first harmonic modeling is performed by using the speech frame's energy envelope estimated signal.

Optionally, the at least one set of second harmonic model components is removed in a plurality of iterations, During each one of the plurality of iterations the following may be performed until a remaining harmonic component cost function is below a threshold. First, a new harmonic model of the previous harmonic model residual may be analyzed to produce new set of harmonic model components. Second, the new set of harmonic components may be removed from the previous harmonic model residual to produce a new harmonic model residual for further iterations.

Optionally, the at least one set of harmonic components removed is stored for later use during decoding of signal and reconstruction of audible output.

Optionally, the at least one second harmonic modeling uses at least one estimated energy envelope signal.

Optionally, the new harmonic modeling uses at least one estimated energy envelope signal.

Optionally, the speech frame is spectrally whitened prior to said first harmonic modeling, and said spectrally whitening is reversed prior to said speech coding analysis.

Optionally, the speech frame is spectrally whitened after said first harmonic modeling, and said spectrally whitening is reversed prior to said speech coding analysis.

Optionally, the harmonically-filtered residual signal is further processed to remove periodic energy envelope modulation by modeling using a sum of multiple instances of a periodic function at arbitrary frequencies taking into account the time-domain energy envelope signal estimate with imposed periodicity before analysis by synthesis coding.

Optionally, the harmonically-filtered residual signal is frequency range filtered before performing said modeling to remove only the frequency range specific periodic energy envelope modulation.

Optionally, the first harmonic model parameters undergo further processing for speech transformation.

According to some embodiments of the present invention there is provided a method for speech parameterization and coding of a continuous speech signal. The method comprises dividing the continuous speech signal into a plurality of speech frames, and for each one of the plurality of speech frames modeling the speech frame by a first harmonic modeling to produce a plurality of harmonic model parameters, reconstructing an estimated frame signal from the plurality of harmonic model parameters, subtracting the estimated frame signal from the speech frame to produce a harmonic model residual signal, removing at least one harmonic components from the first harmonic model residual signal to produce a harmonically-filtered residual signal, removing periodic energy envelope modulation using a second modeling of the harmonically-filtered residual signal using a sum of multiple instances of a periodic function at arbitrary frequencies taking into account the time-domain energy envelope signal estimate with imposed periodicity, and processing the harmonically-filtered residual signal with analysis by synthesis techniques to produce vectors of codebook indices and corresponding gains.

Optionally, the first harmonic modeling is performed by using speech frame's energy envelope estimated signal.

Optionally, the speech frame is spectrally whitened prior to said first harmonic modeling, and said spectrally whitening is reversed prior to said speech coding analysis.

Optionally, the harmonic model residual is spectrally whitened after said first harmonic modeling, and said spectrally whitening is reversed prior to said speech coding analysis.

Optionally, the harmonically-filtered residual signal is frequency range filtered before performing said second modeling to remove only the frequency range specific periodic energy envelope modulation.

Optionally, the first harmonic model parameters undergo further processing for speech transformation.

According to some embodiments of the present invention there is provided an apparatus for speech parameterization and coding of a continuous speech signal. The apparatus comprises at least one input interface for receiving and digitizing the continuous speech signal. The apparatus further comprises at least one processing unit for performing the actions of dividing the continuous speech signal into a plurality of speech frames, and for each one of the plurality of speech frames modeling the speech frame by a first harmonic modeling to produce a plurality of frame model parameters and harmonic model residual, performing at least one second harmonic modeling analysis on the first harmonic model residual to removing at least one set of second harmonic model components from the first harmonic model residual signal to produce a harmonically-filtered residual signal, and processing the harmonically-filtered residual signal with analysis by synthesis techniques to produce vectors of codebook indices and corresponding gains. The apparatus further comprises at least one output interface to send the plurality of speech parameters and codes. The apparatus further comprises a housing for containing the at least one input interface, the at least one processing unit, and the at least one output interface, the housing being configured and suitable for the apparatus environment.

Optionally, the harmonically-filtered residual signal is further processed to remove periodic energy envelope modulation using a modeling action using a sum of multiple instances of a periodic function at arbitrary frequencies taking into account the time-domain energy envelope signal estimate with imposed periodicity before analysis by synthesis coding.

Optionally, the at least one input interface is any member of the group comprising at least one microphone, an analog communication interface, and a digital communication interface.

Optionally, the at least one output interface is any member of the group comprising a digital communication interface, and an audio output interface.

Unless otherwise defined, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention may involve performing or completing selected tasks manually, automatically, or a combination thereof. Moreover, according to actual instrumentation and equipment of embodiments of the method and/or system of the invention, several selected tasks could be implemented by hardware, software or firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 1A is with no spectral whitening, FIG. 1B is with spectral whitening before harmonic modeling, and FIG. 1C is with spectral whitening after harmonic modeling;

DESCRIPTION OF EMBODIMENTS OF THE INVENTION

Figure 1A:
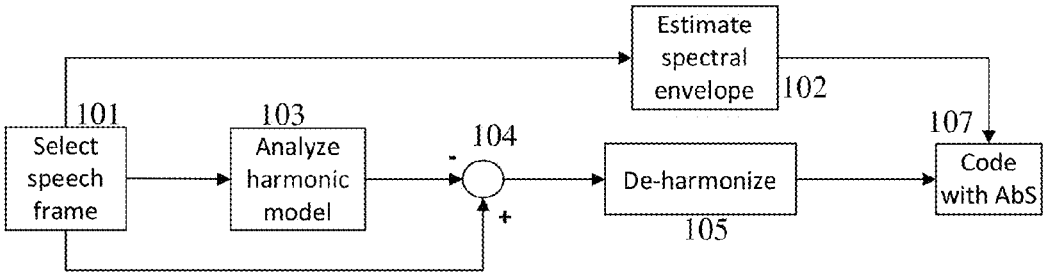
FIG. 1A, FIG. 1B and FIG. 1C are flowcharts of several de-harmonization embodiments with respect to application of spectral whitening.

The present invention, in some embodiments thereof, relates to speech parameterization and coding and, more particularly, but not exclusively, to techniques for speech compression, high quality reconstruction and transformation in the parametric domain.

According to some embodiments of the present invention, there are provided methods and apparatuses for removal of harmonic and/or near-harmonic components from the residual noise signal remaining after speech frame harmonic modeling and before residual noise signal analysis by synthesis, allowing both speech transformation and/or high quality compression for digital transmission. Optionally, some embodiments of the invention go on to further remove pitch-period energy envelope modulations, referred to herein as "periodic modulation filtering". In use, the continuous digitized speech signal may be divided into plurality of speech frames by convolving the speech signal with one or more finite windowing functions, referred to herein as an "analysis windows". For each speech frame it may be determined if it is a voiced or unvoiced speech frame, and each voiced speech frames may be analyzed by harmonic modeling to produce harmonic model amplitudes and/or phases, referred to herein as "HM parameters", and a harmonic model residual, referred to herein as the "HM residual", which is the difference between the fitted harmonic model and the original speech frame signal. The HM residual may be processed, according to some embodiments of the methods and apparatus described herein, to produce a signal with negligible harmonic model components remaining in the HM residual and negligible periodic energy envelope modulation, referred to herein as a "de-harmonized residual". The resulting de-harmonized residual may be further processed using known in the arts analysis by synthesis methods to produce vectors of code indices and their corresponding gains, referred to herein as codewords. Since these codewords were produced after removal of the remaining harmonic model components and analysis window effects, the resulting reconstructed audible signal produced from the HM parameters and codewords, referred to herein as speech parameter data, may be of a better quality after decoding, particularly when further processed by speech transformation.

Optionally, these HM parameters and codewords are compressed and transferred to a remote location for reconstruction, decoding and audible output with improved intelligibility.

Optionally, these HM parameters may undergo speech transformation before audible output with improved quality.

A process of removal of the remaining harmonic and/or near-harmonic components and removal of periodic energy envelope modulation from the HM residual is referred to herein as "de-harmonization", "de-harmonizing" or being "de-harmonized", to produce de-harmonized residual. The de-harmonization process may include methods for harmonic filtering and/or analysis window deconvolution and/or periodic energy envelope modulation filtering.

According to some embodiments of the present invention, a method of harmonic filtering the HM residual, filters out the remaining harmonic and/or near-harmonic components from the HM residual, resulting in a harmonically-filtered residual. The harmonic filtering may be performed by iteratively applying a new harmonic model analysis to the HM residual to find remaining harmonic component sets, removing these harmonic component set from the HM residual, and determining a cost function of the remaining harmonic components in the HM residual. Once the cost function metric is below a given threshold, the remaining harmonic components may be considered negligible.

According to some embodiments of the present invention, a method of periodic energy envelope modulation filtering removes the periodic modulation of the time-domain energy envelope and/or the time domain energy envelope and/or the analysis window. The periodic energy envelope modulation filtering may follow the harmonic filtering stage to discard any remaining periodic energy modulation, termed herein "periodic modulation filtering", that might still be present in the high band and/or the full band of the HM residual after the harmonic filtering. It may be done, for example, by line spectrum modeling (LSM), defined herein, that performs a signal deconvolution using at least one full band and/or partial band periodic window by minimization of the LSM cost function, producing a de-harmonized residual line spectrum for further processing using analysis by synthesis coding.

In some embodiments of the present invention, the methods and/or systems may be applied toward applications in telephony, healthcare and security. In telephony, speech transformation may be applied in voice over internet protocols, speech to text or text to speech applications, and/or voice masking (scrambling). In healthcare applications these methods may be applied to hearing impaired speech processing and voice impaired speech transformation to improve patient's communication ability and quality of life. For example, a patient with a hearing impairment that doesn't hear certain frequency ranges of the normal voice spectrum would have the pitch changed to a range of frequencies that this patient hears with better intelligibility. Another example of healthcare application is an improved electrolarynx device which can reproduce more intelligible speech of patients that have lost their larynx, or reproduce their original voice prior to losing their larynx. In security applications speech transformations may be applied in counter terrorism activities to identify suspects, voice identification for access privileges, and voice masking for intelligence gathering. For example, when monitoring phone conversations, information on mood, intonation or emotional content is acquired in addition to the target keywords, and the conversation flagged at higher priority threat if the combined information would warrant this. Other applications may exist in speech and voice recognition fields, where the pitch, timber and intonation elements may be separately analyzed to better identify and classify the words being spoken.

Before further describing the details of some embodiments of the invention, it is to be understood that the invention is not necessarily limited in application to the details of construction and the arrangement of the components and/or methods set forth in the following description and/or illustrated in the drawings and/or the examples. The invention is capable of other embodiments or of being practiced or carried out in various ways.

Continuous speech may be divided into speech frames, where each speech frame can be "voiced", characterized by a fundamental frequency, and/or containing dominant harmonic and/or near-harmonic components, or "unvoiced" without a fundamental frequency and harmonic components. Optionally, a known in the arts pitch detector is used to determining if the speech frame is purely unvoiced frame with no pitch or a voiced speech frame with an estimated pitch value for further processing.

A process of representation of a voiced signal as a sum of multiple instances of a periodic function, each at harmonic and/or near-harmonic frequencies may be referred to as "harmonic modeling". The harmonic modeling may produce harmonic model parameters, referred to herein as HM parameters, which may consist of a plurality of harmonic amplitudes and/or phases in the vicinity of the pitch-frequency multiples.

A process of representation of any type of speech signal as a sum of multiple instances of a periodic function at arbitrary frequencies is referred to herein as "line spectrum modeling" (LSM). The line spectrum modeling outcome is referred to herein as line spectrum parameters. It may consist of a plurality of amplitudes and/or phases, estimated for example at an evenly and densely spaced set of frequencies.

Unvoiced speech frames may undergo known in the art techniques of spectral envelope estimation followed by analysis-by-synthesis (AbS) coding to produce AbS codes consisting of a plurality of code indices and gains.

Optionally, the HM residual and/or the harmonically-filtered residual and/or the de-harmonized residual are processed in any data domain, for example the time, frequency or line spectrum domains, with appropriate data transformations and changes to the methods herein.

Optionally, the HM parameters are modified before audible output reconstruction so as to produce a speech transformation, such as prosody modification, spectral warping, gender change and/or the like.

Figure 1B:
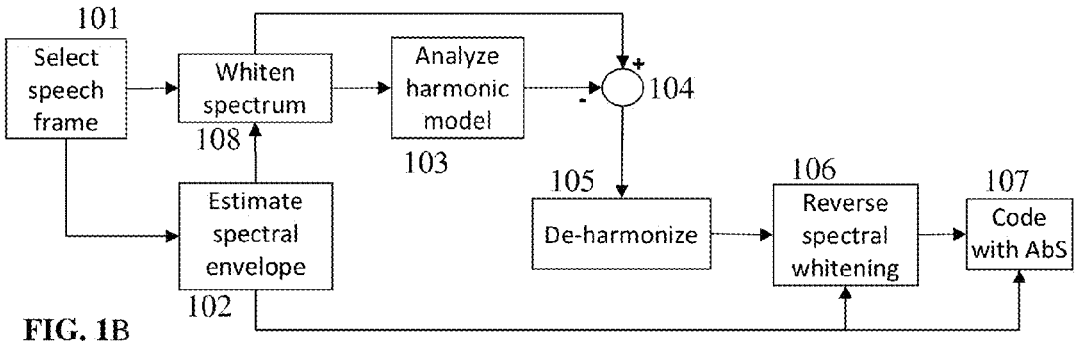
Figure 1C:
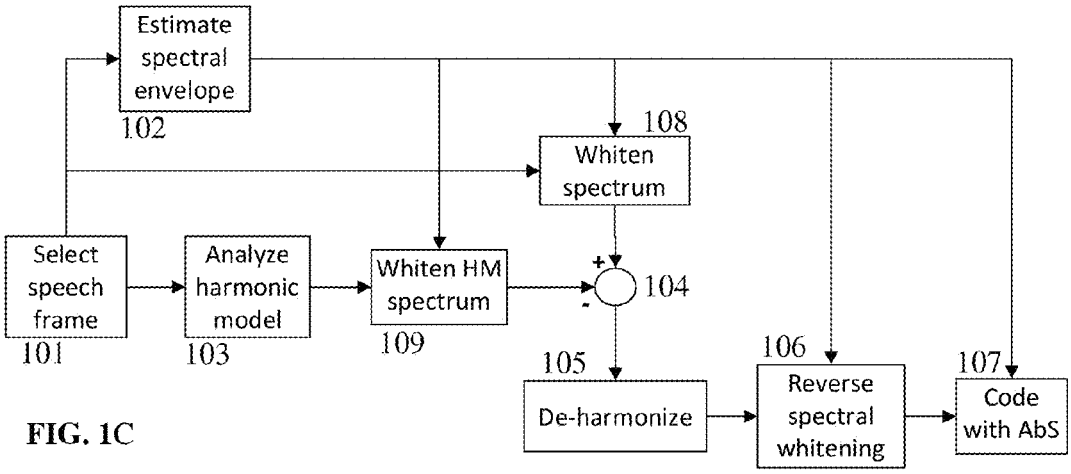

Reference is now made to FIG. 1A, FIG. 1B and FIG. 1C which are flowcharts of signal processing according to some embodiments of the invention. FIG. 1A depicts selecting a speech frame 101 by convolving a windowing function to a continuous speech signal. The speech frame may undergo harmonic model analysis 103 to produce HM parameters. Subsequent to this harmonic modeling, the speech frame HM residual may be computed 104, and the HM residual may be de-harmonized 105. The resulting de-harmonized residual may be coded using a known in the art method for analysis by synthesis coding 107, optionally using an estimate of the spectral envelope energy 102. FIG. 1B depicts, in addition to the actions shown in FIG. 1A, a spectral whitening action 108 that may be applied before the harmonic model 103 using the spectral envelope estimate 102. The spectral whitening may be reversed 106 prior to analysis by synthesis coding 107. FIG. 1C depicts, in addition to the actions shown in FIG. 1A, the optional application of a harmonic model spectral whitener 109 after the harmonic modeling 103 and a separate spectral whitener 108 applied to the original speech frame 101 before subtraction of the two 104 to produce the HM residual which is treated from that point as in the embodiment of FIG. 1B.

In some embodiments of the invention, the harmonic modeling and/or the line spectrum modeling (LSM) may be performed using a known in the art sinusoidal model (SM) and in other embodiments they may be performed using an extended sinusoidal model (XSM). In both SM and XSM the speech frame is modeled as a weighted sum of sine waves. As opposed to the SM, the XSM considers speech frame energy envelope modulations. In the XSM, a time domain energy envelope signal may first be estimated by modeling a speech frame energy modulation. Then, its impact is discarded, together with discarding the impact of the analysis window as done in SM, by minimization of the XSM cost function. The SM and/or XSM output may contain sinusoidal amplitudes and/or phases as well as the optional energy envelope signal estimate.

Optionally, the harmonic modeling and/or the line spectrum modeling (LSM) is performed using any periodic or near-periodic basis function.

Optionally, the sinusoidal amplitudes and phases are further represented by more tractable and compressible parameters, for example by mel-frequency regularized cepstral coefficients (MRCC) for sinusoidal amplitudes and weighted MRCC for the sinusoidal phases, as described by Slava Shechtman and Alex Sorin in "Sinusoidal model parameterization for HMM-based TTS system" from INTERSPEECH 2010, pages 805-808, which is incorporated herein by reference.

Optionally, the time-domain energy envelope signal is computed as a set of slightly smoothed evenly-spaced-in-time measurements of instantaneous signal energy, estimated by window averaging centered over the given instant. This estimated energy envelope signal may later be used for harmonic modeling and/or line spectrum modeling and/or XSM.

Figure 4:
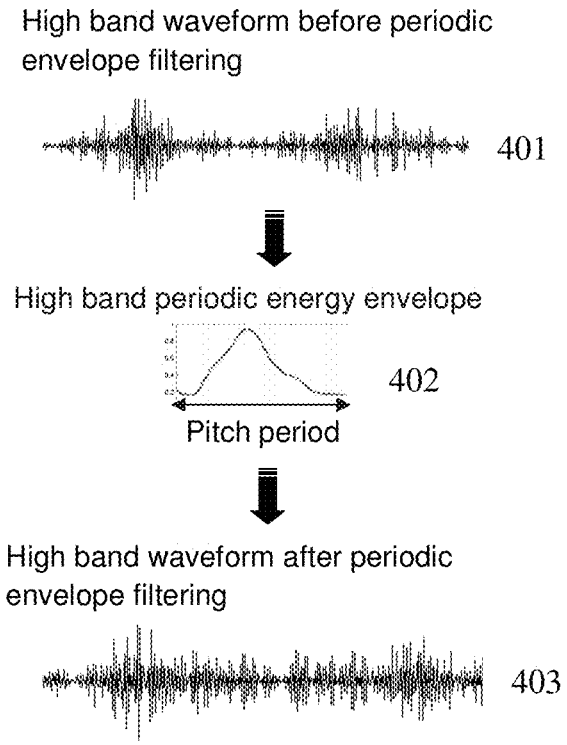
FIG. 4 is a schematic illustration showing the high-band signal change following application of a periodic energy envelope.

Reference is now made to FIG. 4, which is a schematic illustration showing the high-band signal change following filtering of a periodic energy envelope. As at 401 there is shown a high band speech frame waveform. Once the periodic high band energy envelope, with the pitch periodicity, as at 402, is estimated and removed, the resulting high band waveform as at 403 shows no periodicity in the energy envelope.

Optionally, the HM residual is obtained by reconstruction of the time domain signal represented by the harmonic model, and subtraction from the corresponding windowed speech frame. Optionally, the HM residual can be computed in the frequency domain and/or the line spectrum domain, where the reconstructed harmonic model speech frame signal and unprocessed speech frame signal have undergone the appropriate transformations between the domains.

As an example of remaining harmonic components in the HM residual, it is understood that given a method for modeling the speech frame with a harmonic model and minimizing a cost function to find the best fit of the model to the signal, there exist parts of the signal that fit the model with less accuracy. When the best fit model is subtracted from the original speech frame, the resulting HM residual may contain additional, un-modeled harmonic components at frequencies that are the same or different than the harmonic frequencies used by the harmonic model.

For example, the harmonic filtering algorithm applies a new harmonic model to the HM residual, removes the harmonic component sets found by the model, computes a cost function of the remaining harmonic components, and repeats this for multiple iterations until the cost function is below a threshold, producing a harmonically filtered residual with negligible harmonic components. For example, the method uses a constant-length-synthesis-window applied on the speech frame, performs harmonic frequency peak picking choosing the same or different frequencies from previously applied harmonic models, estimates a new harmonic model fit to the HM residual, subtracts a reconstructed harmonic model signal from the HM residual and computes a cost function. The harmonic component sets that are removed by the harmonic filtering technique may be either discarded or saved for reconstruction of the original signal later.

Optionally, the harmonic filtering is applied to the low pass filtered and/or the full-band speech frame.

Optionally, a harmonic notch filter may be applied to HM residual to remove some harmonic components, as described by Xiaochun Guan, Xiaojing Chen, and Guichu Wu in "Implementation of harmonic IIR notch filter with the TMS320C55x" [3rd International Congress on Image and Signal Processing (CISP) 2010, vol. 7, no., pp. 3195-3199, 16-18 Oct. 2010], and incorporated herein by reference.

In the periodic modulation filter embodiment described herein, the HM residual signal and/or the harmonically-filtered residual may be filtered out below $f_{th}$ to produce a high-band signal, and the energy envelope signal of this high-band may be estimated. This high-band energy envelope signal may be further processed to impose periodicity of the energy envelope signal. This periodicity imposed energy envelope signal may then be used by the subsequent LSM analysis to optionally remove periodic energy envelope modulation and/or the analysis window effects and/or the time domain energy envelope, with the results optionally represented in the line spectrum domain. The resulting de-harmonized residual line spectrum may then be coded as described herein, for example, using the known in the art code-excited linear prediction method.

Optionally, the de-harmonized residual is coded using a set of spectrally flat, normalized codewords chosen from a predefined codebook. Given this codebook, an exhaustive search may be performed to find the codeword indices and corresponding gains which provide the best fit in a perceptual spectral domain, producing vectors of codes and/or gains.

Figure 2:
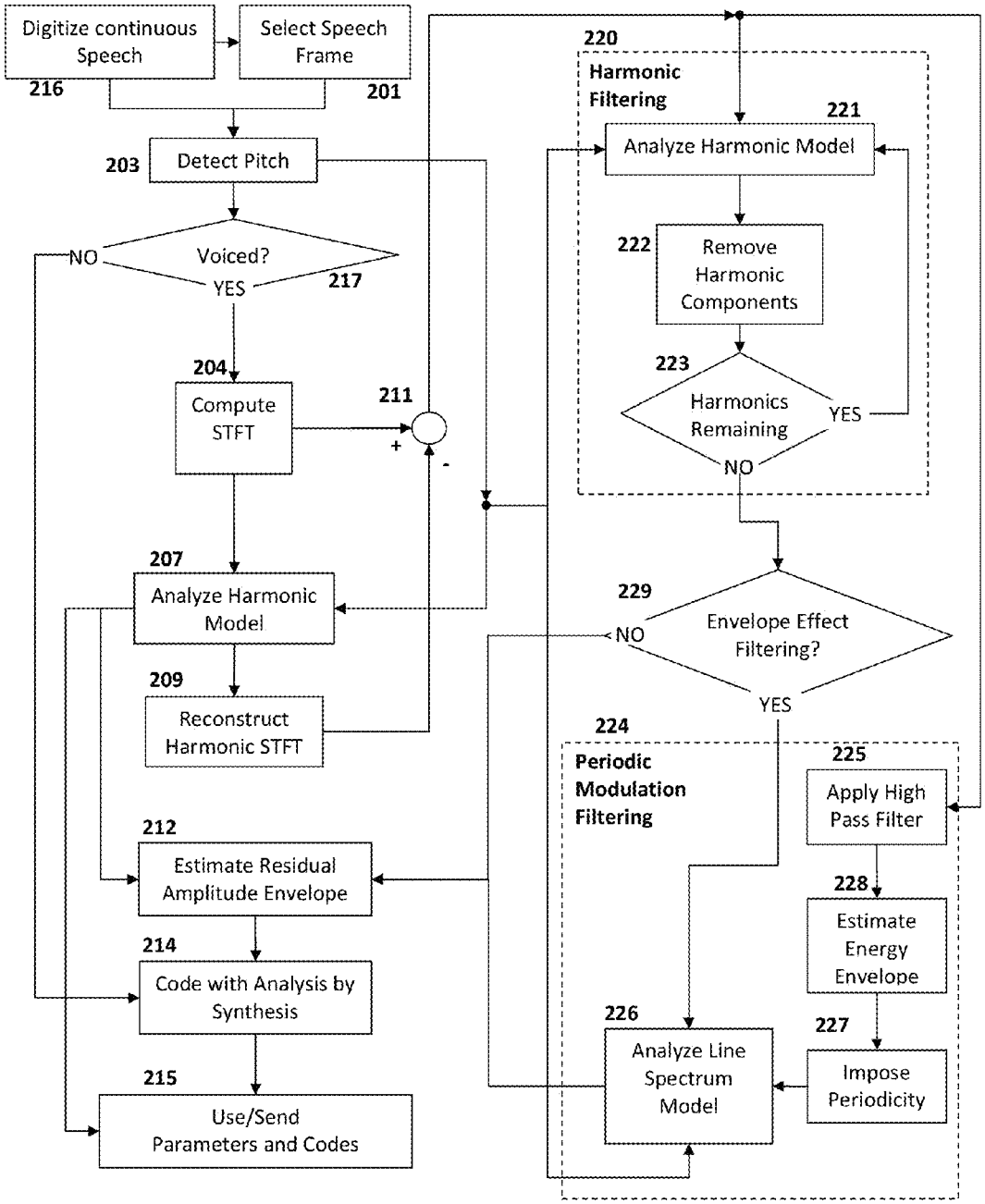
FIG. 2 is a flowchart of one embodiment of the invention with some embodiments of the harmonic filtering and periodic modulation filtering actions.

Reference is now also made to FIG. 2, which is a flowchart of harmonic filtering and periodic modulation filtering actions for a voiced speech frame, according to some embodiments of the present invention. The following description according to some embodiments of the invention will use the references from FIG. 2 within for clarification.

In FIG. 2, a speech frame is selected 201 from the continuous speech signal as at 216. This speech frame may first undergo a pitch detector 203 to determine if the speech frame is voiced or unvoiced, and if voiced, determine its pitch value. In case of a purely unvoiced speech frame, the frame undergoes a separate dataflow for the purely unvoiced frames that does not require de-harmonization. The voiced frame continues to estimate the Short Time Fourier Transformation (STFT) signal using an appropriate windowing and Fourier transformation method 204. These data may be further processed to analyze a harmonic model 207 of the speech frame which produces amplitudes and phases at the STFT maxima in the vicinity of the pitch multiples. By reconstructing a harmonic model STFT signal 209 from these amplitudes and phases, and subtracting 211 the unprocessed STFT signal computed in 204, a HM residual may be generated.

This HM residual along with the pitch from 203 may have remaining harmonic components removed by iteratively applying a new harmonic modeling analysis 220. In some embodiments of this method, the HM residual is iteratively analyzed by a harmonic model 221, the low-band and/or full-band harmonic components are removed 222, and a cost function is calculated to determine if there are remaining harmonic components 223. If the HM residual remaining harmonic components are not below a certain threshold as determined by the cost function, the iterative process is repeated till the harmonic components of the HM residual are negligible resulting in a harmonically-filtered residual.

For example, in some embodiments of the invention the harmonic filtering action is described as:

let sin_mod(i) be a harmonic model 221 representation of i-th frame of speech, up to a predetermined angular frequency $f_{th}$, where $f_{th}$ may be set for example at 4 kHz, and let s(i) be a full band speech frame, then r(i)=s(i)−sin_mod(i) 222 is a low-band harmonic model residual of the i-th frame.

In some of the preferred embodiments, s(i), sin_mod(i) and r(i) are estimated in frequency domain using short time Fourier transformations (STFT).

We may define a cost function as the relative harmonicity threshold of the i-th frame as R(i)=norm(r(i))/norm(s_LB(i)), where s_LB(i), is a low-passed version of s(i), filtered out above the frequency $f_{th}$.

We may then iterate using the method described herein until the low-band and/or full-band harmonic components are negligible 223, for example less then R(i).

An exemplary pseudocode of some embodiments of the harmonic filtering method are provided herein:

```
j=0
rr(j) = r(i)
rr_sin_mod_supp = 0;
while (rr(j) > R(i)) { 223
        - select as set of harmonic or near-harmonic frequencies by
    harmonic peak picking of rr(j) up to f_th
        - estimate the harmonic model, based on the chosen frequencies,
    rr_sin_mod(j) 221
        rr(j+1) =rr(j) − rr_sin_mod(j) 222
        rr_sin_mod_supp = rr_sin_mod_supp + rr_sin_mod(j)
        N_iter = j
        j=j+1
    }
RR(i) = rr(N_iter)
```

The supplementary harmonic line_spectrum rr_sin_mod_supp may be discarded or separately modeled with an energy envelope signal and AbS coding.

In some embodiments of the present invention, the resulting harmonically-filtered residual may be represented in line-spectral domain. In other embodiments of the present invention, the resulting harmonically-filtered residual may be represented either in the time domain or in the frequency domain.

If requested 229, the harmonically-filtered residual may be further processed for periodic modulation filtering 224 by analyzing harmonically-filtered residual using a line spectrum model 226, while discarding a high-pass filtered energy envelope signal with imposed periodicity, which may be computed by applying a high pass filter 225 to the HM residual, estimating the filtered residual's energy envelope signal 228, and imposing periodicity as described herein 227. This line spectrum model may optionally use the full-band energy envelope signal to discard the full-band speech frame energy modulation too.

For example, a periodic energy envelope signal $t^i_T(n)$ is computed, as at 226 followed by 227, from the time domain high-pass filtered HM residual as described herein.

Optionally, this periodic energy envelope signal is computed from the HM residual or the harmonically-filtered residual.

The method may impose periodicity 227 of the energy envelope signal 228 to produce a periodic energy envelope signal, by using the equation:

$$t^i_T(n) = \sum_k t^i(n+kT)w(n+kT) \Big/ \sum_k w(n+kT),$$

where w(n) denotes a windowing function.

For example, in the HM residual, RR(i), there are still some harmonic components remaining at the high band, above $f_{th}$. We may optionally represent these harmonic components by the periodic energy envelope signal, as at 225 and 228, and remove them by XSM analysis (226).

For example, if both the full-band energy envelope signal and the high-band energy envelope signal are given, we may write down the XSM formulation:

$$RR(i) \approx \sum_{k=1}^{M} w(n)\sigma^i(n)A_k\cos(f_{0,UV}kn+\varphi_k) + \sum_{k=M+1}^{L} w(n)\sigma^i(n)t^i_T(n)A_k\cos(f_{0,UV}kn+\varphi_k)$$

where $\sigma^i(n)$ is a full-band time-domain energy envelope signal, referred to as a speech frame energy modulation curve, $t^i_T(n)$ is a high band periodic time-domain energy envelope signal, $f_{o,UV}$ is an arbitrary (small enough) angular frequency spacing and $M=\lfloor F_th/f_{0,UV}\rfloor$.

The XSM formulation can be simplified with the appropriate definition of $w_{env}(n,k)$:

$$RR(i) \approx \sum_{k=1}^{L} w_{env}(n,k)A_k\cos(f_{0,UV}kn+\varphi_k)$$

and represented in frequency domain by:

$$W_1c_{Re}+jW_2c_{Im},$$

where $W_1$ and $W_2$ denote matrices containing shifted replicas of the envelope window frequency transforms varying in frequency (depending on k) as their columns $$\begin{cases} w_1(m,k) = \frac{1}{2}W_{env,k}\left(\frac{2\pi m}{N_{FFT}} - \theta_k\right) + \frac{1}{2}W_{env,k}\left(\frac{2\pi m}{N_{FFT}} + \theta_k\right) \\ w_2(m,k) = \frac{1}{2}W_{env,k}\left(\frac{2\pi m}{N_{FFT}} - \theta_k\right) - \frac{1}{2}W_{env,k}\left(\frac{2\pi m}{N_{FFT}} + \theta_k\right) \end{cases}, \quad \begin{matrix} 0 \le m \le N_{FFT}/2 \\ 0 \le k \le L \end{matrix}.$$

and $$c \triangleq \{c_k\}_{k=0}^{L} \triangleq \{c_{Re,k} + jc_{Im,k}\}_{k=0}^{L}$$

is a line spectrum estimated by the XSM.

Now, the XSM output line spectrum $c \triangleq \{c_k\}_{k=0}^{L} \triangleq \{c_{Re,k} + jc_{Im,k}\}_{k=0}^{L}$ may be obtained by the generalized XSM solution 226 in frequency domain:

$$\begin{bmatrix} \mathrm{Re}(W_1^H W_1) & -\mathrm{Im}(W_1^H W_2) \\ \mathrm{Im}(W_2^H W_1) & \mathrm{Re}(W_2^H W_1) \end{bmatrix} \begin{bmatrix} c_{Re} \\ c_{Im} \end{bmatrix} = \begin{bmatrix} \mathrm{Re}(W_2^H S) \\ \mathrm{Im}(W_1^H S) \end{bmatrix}, .$$

The de-harmonized residual line spectrum (DRLS) may be obtained from the HM residual by performing line spectrum modeling 226 in the line spectrum domain aware of the high-band time-domain periodic energy envelope signal and optionally the full-band time-domain energy envelope signal described herein. If the full-band time-domain energy envelope signal is not estimated, it can be substituted by unity in the XSM formulation ($\sigma_i(n)=1$)

The DRLS may then be quantized by AbS coding 214 as described herein.

The DRLS amplitudes are optionally estimated (212) complementary to the original harmonic amplitudes, and/or their described herein MRCC representation, from the original harmonic model 207. The estimation is done, for example, by the all-pole linear prediction coding (LPC) spectral envelope, represented by Line Spectral Frequencies (LSF). For example, lets be the original harmonic amplitudes vector from 207 or the described herein MRCC representation, sampled at appropriate evenly spaced frequencies, and let r be the DRLS amplitudes vector, then the sampled residual amplitude envelope e is obtained as the sampled LPC spectrum of r component-wise divided by s, so that r is approximated by s component-wise multiplied by e.

Optionally, Analysis by Synthesis (AbS) 214 coding is performed on the de-harmonized residual either in frequency domain, time domains or line spectrum domain. Further optionally, the spectral envelope estimate is used for AbS coding. For example, let the AbS codebook search be performed in line spectral domain, r be the DRLS amplitudes vector and e be the sampled residual amplitude envelope vector, then we define a target for AbS codebook search to be y=r/e.

Optionally, Analysis-by-Synthesis codebook search 214 is performed on the harmonically-filtered residual resulting from the harmonic filtering 220 or the DRLS resulting from periodic modulation filter method 224. The de-harmonized residual in the time, frequency or line spectral domains may be represented by a set of spectrally flat, normalized noise codeword indices and their gains. In general, each codeword may represent a certain sub-frame, time domain, and sub-band, frequency domain, of the de-harmonized residual and/or de-harmonized residual line spectrum. For example, given a plurality of noise codebooks, an exhaustive search may be performed to find the codewords and the corresponding gains which provide the least distortion in a perceptually weighted domain, such as found using known in the art the code-excited linear prediction method.

Optionally, the search 214 is performed in the line spectrum domain, separated to several sub-bands and/or sub-frames. For example, let y=r/e be a sub-band/sub-frame codebook search target, W is a perceptual weighting filter (diagonal matrix), S is a sampled spectral envelope (diagonal matrix), and $x_i$ is the i-th codeword. Within the specific codebook being searched, the optimal gain may be given by:

$$g_i = \frac{\mathrm{Re}(x_i^H S W^2 y)}{\mathrm{Re}(x_i^H S^2 W^2 x_i)}$$

and the codeword is selected according to:

$$x^* = \underset{i}{\mathrm{argmax}}(g_i \mathrm{Re}(x_i^H S W^2 y)).$$

Figure 3:
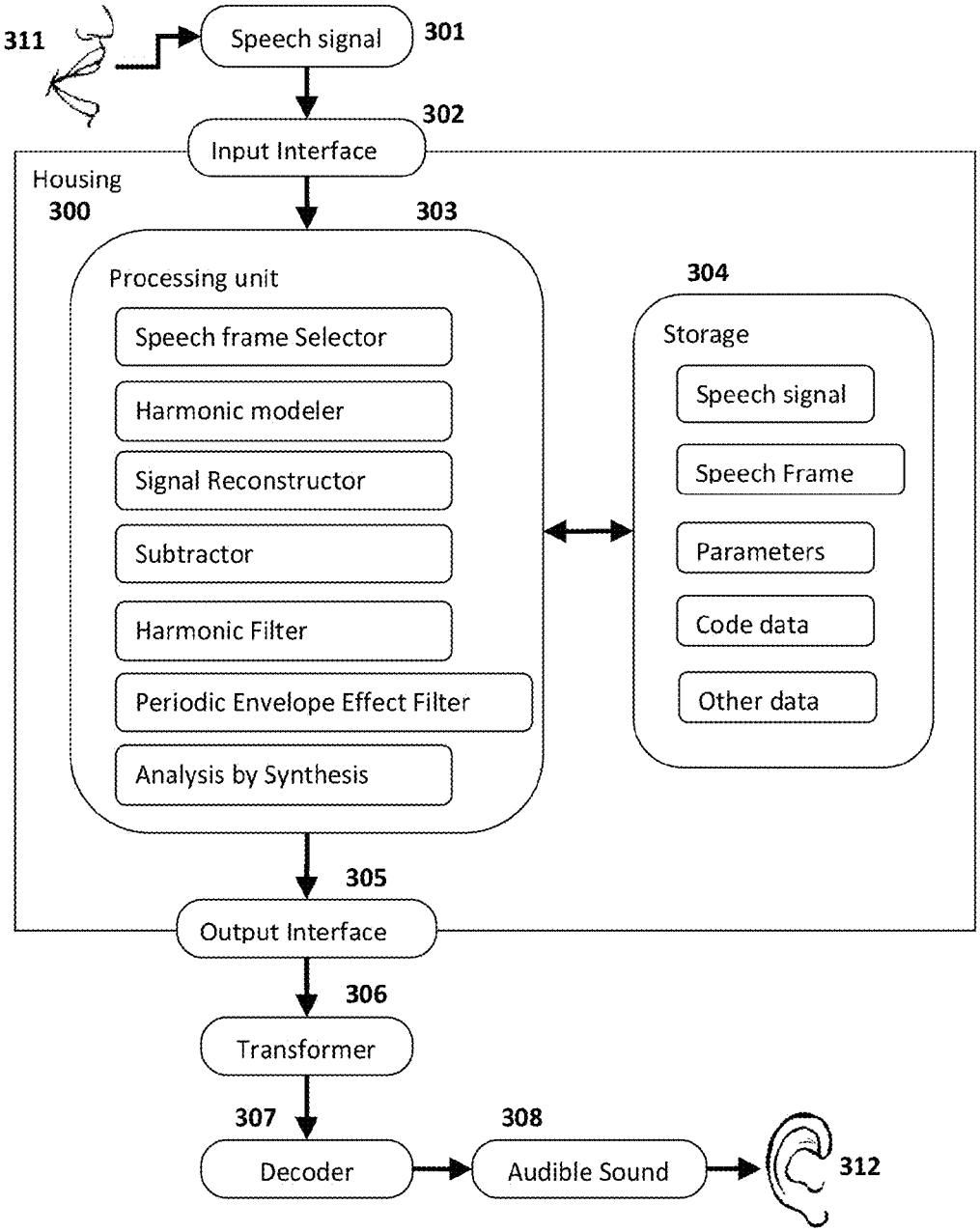
FIG. 3 is a schematic representation of one embodiment of an apparatus to implement the invention.

Reference is now also made to FIG. 3, which is a schematic diagram of an apparatus capable of performing the methods described herein in some embodiments of the present invention. Such an apparatus may have a processing unit 303, storage unit 304, input interface 302, and output interface 305. Optionally, all components are placed in a housing 300 suitable for the environment in which the apparatus will be operated.

When a person 311 produces speech 301 in a continuous stream, and input interface 302 collects this stream and digitizes the continuous speech stream for processing. The processing unit may perform the speech frame parameterization and coding described herein, with optionally saving the intermediate and/or final data on a storage unit 304. Saving these data may allow robust error correction functions to be performed. These resulting parameters and/or codes and/or other data, such as pitch and/or energy envelope signal, collectively referred to herein as "speech data", are compressed and exit the apparatus through an output interface 305. These speech data may be decoded using the appropriate decoder 307 to convert the speech data to audible sounds 308 that may be intelligibly heard by another person and/or the same person 312.

Optionally, the decoder 307 may be part of the apparatus and reside in the housing 300.

Optionally, these speech data are transformed by an appropriate speech transformer 306 for changes to the audible sound as described herein. Optionally, this speech transformer 306 may be part of the apparatus and reside in the housing 300.

Optionally, said processing unit 303 is an embedded microcontroller type unit.

Optionally, said processing unit 303 is a digital signal processing unit.

Optionally, said storage unit 304 is one or more of the following types of storage units: hard disk, solid state disk, non-volatile memory disk, EEPROM, and alike.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or actions, but only if the additional ingredients and/or actions do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method for speech parameterization and coding of a continuous speech signal, comprising:

receiving a continuous speech signal representing speech recorded by at least one microphone, dividing said continuous speech signal into a plurality of speech frames, and for each one of said plurality of speech frames:

modeling said speech frame by a first harmonic modeling to produce a plurality of harmonic model parameter values, wherein said first harmonic modeling is estimated by computing a cost function between a plurality of sine function signals and said speech frame, wherein each of said plurality of sine function signals comprises one of a plurality of harmonic frequencies, an amplitude value and a phrase value;

reconstructing an estimated frame signal from said plurality of harmonic model parameter values;

subtracting said estimated frame signal from said speech frame to produce a harmonic model residual signal;

performing at least one second harmonic modeling analysis on said first harmonic model residual to determine at least one set of second harmonic model component values;

removing said at least one set of second harmonic model component values from said first harmonic model residual signal to produce a harmonically-filtered residual signal; and processing said harmonically-filtered residual signal with analysis by synthesis techniques to produce vectors of codebook indices and corresponding gains, and sending said plurality of harmonic model parameter values and said codebook vector indices and corresponding gains to a speech processor configured to compute at least one of a speech transformation, a signal compression and a conversion to an audible sound output.

2. The method of claim 1, wherein said harmonic modeling is performed by using speech frame's energy envelope estimated signal.

3. The method of claim 1, wherein said at least one set of second harmonic model component values is removed in a plurality of iterations so that during each one of said plurality of iterations the following is performed until a remaining harmonic component cost function is below a threshold:

analyzing new harmonic model of previous harmonic model residual to produce new set of harmonic model component values, removing said new set of harmonic component values from said previous harmonic model residual to produce a new harmonic model residual for further iterations.

4. The method of claim 1, wherein said removed at least one set of harmonic component values is stored for later use during decoding of signal and reconstruction of audible output.

5. The method of claim 3, wherein said new harmonic modeling uses at least one estimated energy envelope signal.

6. The method of claim 1, wherein said speech frame is spectrally whitened prior to said first harmonic modeling, and said spectrally whitening is reversed prior to said speech coding analysis.

7. The method of claim 1, wherein said speech frame is spectrally whitened after said first harmonic modeling, and said spectrally whitening is reversed prior to said speech coding analysis.

8. The method of claim 1, wherein said harmonically-filtered residual signal is further processed to remove periodic energy envelope modulation by modeling using a sum of multiple instances of a periodic function at arbitrary frequencies taking into account the time-domain energy envelope signal estimate with imposed periodicity before analysis by synthesis coding.

9. The method of claim 8, wherein said harmonically-filtered residual signal is frequency range filtered before performing said modeling to remove only the frequency range specific periodic energy envelope modulation.

10. The method of claim 1, where said first harmonic model parameter values undergo further processing for speech transformation.

11. A method for speech parameterization and coding of a continuous speech signal, comprising:

receiving a continuous speech signal representing speech recorded by at least one microphone, dividing said speech signal into a plurality of speech frames;

for each one of said plurality of speech frames:

modeling said speech frame by a first harmonic modeling to produce a plurality of harmonic model parameter values, wherein said first harmonic modeling is estimated by computing a cost function between a plurality of sine function signals and said speech frame, wherein each of said plurality of sine function signals comprises one of a plurality of harmonic frequencies, an amplitude value and a phrase value;

reconstructing an estimated frame signal from said plurality of harmonic model parameter values;

subtracting said estimated frame signal from said speech frame to produce a harmonic model residual signal;

removing at least one harmonic component value from said first harmonic model residual signal to produce a harmonically-filtered residual signal;

removing periodic energy envelope modulation using a second modeling of said harmonically-filtered residual signal using a sum of multiple instances of a periodic function at arbitrary frequencies taking into account the time-domain energy envelope signal estimate with imposed periodicity; and processing said harmonically-filtered residual signal with analysis by synthesis techniques to produce vectors of codebook indices and corresponding gains, and sending said plurality of harmonic model parameter values and said codebook vector indices and corresponding gains to a speech processor configured to compute at least one of a speech transformation, a signal compression and a conversion to an audible sound output.

12. The method of claim 11, wherein said first harmonic modeling is performed by using speech frame's energy envelope estimated signal.

13. The method of claim 11, wherein said speech frame is spectrally whitened prior to said first harmonic modeling, and said spectrally whitening is reversed prior to said speech coding analysis.

14. The method of claim 11, wherein said harmonic model residual is spectrally whitened after said first harmonic modeling, and said spectrally whitening is reversed prior to said speech coding analysis.

15. The method of claim 11, wherein said harmonically-filtered residual signal is frequency range filtered before performing said second modeling to remove only the frequency range specific periodic energy envelope modulation.

16. The method of claim 11, where said first harmonic model parameter values undergo further processing for speech transformation.

17. An apparatus for speech parameterization and coding of a continuous speech signal, comprising:

at least one input interface for receiving and digitizing said continuous speech signal;

at least one processing unit for performing the actions of:

receiving a continuous speech signal representing speech recorded by at least one microphone, dividing said continuous speech signal into a plurality of speech frames, and for each one of said plurality of speech frames:

modeling said speech frame by a first harmonic model to produce a plurality of frame model parameter values and harmonic model residual, wherein said first harmonic modeling is estimated by computing a cost function between a plurality of sine function signals and said speech frame, wherein each of said plurality of sine function signals comprises one of a plurality of harmonic frequencies, an amplitude value and a phrase value;

performing at least one second harmonic modeling analysis on said first harmonic model residual to remove at least one set of second harmonic model component values from said first harmonic model residual signal to produce a harmonically-filtered residual signal; and processing said harmonically-filtered residual signal with analysis by synthesis techniques to produce vectors of codebook indices and corresponding gains, and sending said plurality of harmonic model parameter values and said codebook vector indices and corresponding gains to a speech processor configured to compute at least one of a speech transformation, a signal compression and a conversion to an audible sound output;

at least one output interface to send said plurality of speech parameter values and codes; and a housing for containing said at least one input interface, said at least one processing unit, and said at least one output interface, said housing being configured and suitable for the apparatus environment.

18. The apparatus of claim 17, wherein said harmonically-filtered residual signal is further processed to remove periodic energy envelope modulation using a modeling action using a sum of multiple instances of a periodic function at arbitrary frequencies taking into account the time-domain energy envelope signal estimate with imposed periodicity before analysis by synthesis coding.

19. The apparatus of claim 17, wherein said at least one input interface is any member of the group comprising:

said at least one microphone;

an analog communication interface; and a digital communication interface.

20. The apparatus of claim 17, wherein said at least one output interface is any member of the group comprising:

a digital communication interface; and an audio output interface.

* * * * *